US009181644B2

(12) United States Patent
Okada et al.

(10) Patent No.: US 9,181,644 B2
(45) Date of Patent: Nov. 10, 2015

(54) BUTTONHOLE PRESSER DEVICE AND METHOD OF STITCHING BUTTONHOLE BY USING THE SAME

(71) Applicant: JANOME SEWING MACHINE CO., LTD., Hachioji-shi, Tokyo (JP)

(72) Inventors: Mizuki Okada, Hachioji (JP); Koji Maeda, Hachioji (JP); Eiichi Syomura, Hachioji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 14/460,872

(22) Filed: Aug. 15, 2014

(65) Prior Publication Data

US 2015/0090169 A1 Apr. 2, 2015

(30) Foreign Application Priority Data

Sep. 30, 2013 (JP) ..... 2013-203871

(51) Int. Cl.
*D05B 29/06* (2006.01)
*D05B 3/06* (2006.01)
*D05B 3/14* (2006.01)

(52) U.S. Cl.
CPC *D05B 29/06* (2013.01); *D05B 3/06* (2013.01); *D05B 3/14* (2013.01)

(58) Field of Classification Search
CPC ..... D05B 29/06; D05B 29/08; D05B 29/12; D05B 3/08; D05B 3/06; D05B 3/14; D05B 3/22
See application file for complete search history.

(56) References Cited

U.S. PATENT DOCUMENTS

| | | | | |
|---|---|---|---|---|
| 3,421,463 | A * | 1/1969 | Happe | D05B 3/24 112/160 |
| 3,656,443 | A * | 4/1972 | Ross | D05B 3/24 112/235 |
| 3,877,403 | A * | 4/1975 | Ketterer | D05B 3/24 112/77 |
| 4,091,752 | A * | 5/1978 | Odermann | D05B 3/24 112/75 |
| 4,096,811 | A * | 6/1978 | Marsh | D05B 3/24 112/77 |
| 4,109,591 | A * | 8/1978 | Rakacs | D05B 3/06 112/76 |
| 4,181,087 | A | 1/1980 | Brauch et al. | |

(Continued)

FOREIGN PATENT DOCUMENTS

| | | | |
|---|---|---|---|
| JP | 62-40035 | B2 | 8/1987 |
| JP | 01034396 | A * | 2/1989 |

(Continued)

*Primary Examiner* — Danny Worrell
(74) *Attorney, Agent, or Firm* — Westerman, Hattori, Daniels & Adrian, LLP

(57) ABSTRACT

A buttonhole presser device includes a fabric presser unit; a fabric feed frame unit including a start position detecting member and an immovable receiving portion, the fabric feed frame unit being slidable relative to the fabric presser unit between a start position and an end position of the buttonhole; a button-diameter measuring unit including an end position detecting member and a movable receiving portion, the button-diameter measuring unit being configured to grip a button by being slid relative to the fabric feed frame unit; and a fixing unit that fixes the button-diameter measuring unit to the fabric feed frame unit when the button-diameter measuring unit is gripping the button between the immovable receiving portion and the movable receiving portion and that allows the button to be removed after the button-diameter measuring unit has been fixed to the fabric feed frame unit.

12 Claims, 6 Drawing Sheets

(56) References Cited

U.S. PATENT DOCUMENTS

| | | | | | |
|---|---|---|---|---|---|
| 4,196,680 | A * | 4/1980 | Edwards | D05B 3/24 | 112/77 |
| 4,197,803 | A * | 4/1980 | Marsh | D05B 3/24 | 112/235 |
| 4,242,976 | A * | 1/1981 | Beckerman | D05B 3/24 | 112/475.25 |
| 8,100,069 | B2 * | 1/2012 | Asaba | D05B 3/06 | 112/447 |
| 2015/0090169 | A1 * | 4/2015 | Okada | D05B 3/06 | 112/475.25 |

FOREIGN PATENT DOCUMENTS

| | | | | |
|---|---|---|---|---|
| JP | 5-309186 | A | | 11/1993 |
| JP | 05293267 | A | * | 11/1993 |
| JP | 2000102681 | A | * | 4/2000 |

* cited by examiner

BUTTONHOLE PRESSER DEVICE AND METHOD OF STITCHING BUTTONHOLE BY USING THE SAME

BACKGROUND OF THE INVENTION

1. Field of the Invention

The present invention relates to a buttonhole presser device that is attached to a zigzag sewing machine and used when stitching a buttonhole. In particular, the present invention relates to a buttonhole presser device that is capable of measuring the diameter of a button and stitching a buttonhole having a length corresponding to the measured diameter of the button and a method of stitching a buttonhole by using the buttonhole presser device.

2. Description of the Related Art

As illustrated in FIGS. 6A to 6E, in order to stitch a buttonhole by using a zigzag sewing machine, it is necessary to draw a buttonhole mark Mc at a position on a piece of fabric where a buttonhole is to be stitched, lift a presser foot and place the piece of fabric between the presser foot and a needle plate so that a needle passes through a start point Ms of the buttonhole mark Mc, stitch left and right line tacks and upper and lower bar tacks as illustrated in FIG. 6E, and switch the fabric feed direction in accordance with the length of the buttonhole mark Mc between the start point Ms and the end point Me. However, it is necessary for a user to pay careful attention in order to set the length of a buttonhole in accordance with the size of a button and switch the fabric feed direction at the start point or the end point of the buttonhole. Therefore, stitching a buttonhole is cumbersome for a user.

To solve the problem, buttonhole presser devices of zigzag sewing machines having the following structures have been developed (see, for example, Japanese Examined Patent Application Publication No. 62-40035 (U.S. Pat. No. 4,181,087), and Japanese Unexamined Patent Application Publication No. 5-309186). Each of the buttonhole presser devices includes a fabric feed frame unit that is slidably attached to a fabric presser. The fabric feed frame unit has a frame in which an elongated hole, for allowing a buttonhole to be stitched, is formed. The buttonhole presser device includes a button-diameter measuring unit for measuring the diameter of a button. The buttonhole presser further includes switching means for automatically switching the fabric feed direction by setting the length of a buttonhole corresponding to the diameter of a button gripped by the button-diameter measuring unit.

However, the button-diameter measuring units of the buttonhole presser devices described in Japanese Examined Patent Application Publication No. 62-40035 and Japanese Unexamined Patent Application Publication No. 5-309186 have the following problems. First, members of the presser devices for gripping a button therebetween are designed for gripping a circular button. Second, the members are capable of holding a button having a diameter smaller than about 25 mm, and it is not possible to stitch a buttonhole for a button having a larger size.

In recent years, ornamental buttons having a diameter greater than 25 mm are widely used, and therefore an increasing number of users want to stitch buttonholes for large buttons. Moreover, large buttons that are not circular but elliptical, polygonal (such as pentagonal), flower-shaped, or in the shapes of cartoon characters are being increasingly used.

It may be possible to stitch a buttonhole for a large button having a diameter greater than 25 mm by increasing the size of button-diameter measuring means of an existing buttonhole presser device. However, by only doing so, it may not be possible to stitch buttonholes for large buttons having noncircular irregular shapes. When attaching a noncircular button to a garment, it is important to attach the button in the correct orientation and it is necessary to change the length of the buttonhole in accordance with the orientation of the button. However, existing button-diameter measuring means has a problem in that, because the button may naturally rotate relative to a member for gripping the button depending on the orientation of the button, the button might not be gripped in an appropriate orientation and the button may become removed from the button-diameter measuring means.

When the buttonhole presser device is attached to a zigzag sewing machine in a state in which the button-diameter measuring means is gripping a large button having a considerable weight, the buttonhole presser device may become inclined due to the weight of the large button. As a result, a problem arises in that it is difficult to set a piece of fabric in which a buttonhole is to be formed.

Existing button-diameter measuring units perform positioning of a button by using a latch mechanism having a predetermined pitch. Therefore, it is difficult for the button-diameter measuring units to correctly measure the diameter of a button with a precision smaller than the pitch. Furthermore, because the latch mechanism is not securely fixed, the position of the button-diameter measuring unit may be easily displaced due to an accidental impact, and therefore the measured diameter of a button may be changed. As a result, there is a problem in that it is difficult to repeatedly stitch buttonholes having the same size.

SUMMARY OF THE INVENTION

In order to solve the problems described above, the present invention provides a buttonhole presser device that can stitch a buttonhole having a length corresponding the orientation in which a button is attached to a garment even if the button is a large button having a noncircular irregular shape and a method of stitching a buttonhole by using the buttonhole presser device.

According to a first aspect of the present invention, there is provided a buttonhole presser device for stitching a buttonhole having a length corresponding to a diameter of a button by measuring the diameter of the button and automatically switching a fabric feed direction on the basis of the measured diameter of the button. The buttonhole presser device includes a fabric presser unit attached to a presser bar of the zigzag sewing machine and having an opening that allows a needle to pass therethrough; a fabric feed frame unit including a start position detecting member and an immovable receiving portion that has a frictional contact surface that contacts one end of a button, the fabric feed frame unit being slidable relative to the fabric presser unit between a start position and an end position of the buttonhole; a button-diameter measuring unit including an end position detecting member and a movable receiving portion that has a frictional contact surface that contacts the other end of the button, the button-diameter measuring unit being configured to grip the button by being slid relative to the fabric feed frame unit; and a fixing unit that fixes the button-diameter measuring unit to the fabric feed frame unit when the button-diameter measuring unit is gripping the button between the immovable receiving portion and the movable receiving portion and that allows the button to be removed after the button-diameter measuring unit has been fixed to the fabric feed frame unit.

According to a second aspect of the present invention, there is provided a method for stitching a buttonhole having a length corresponding to a diameter of a button by measuring the diameter of the button and automatically switching a fabric feed direction on the basis of the measured diameter of the button by using a buttonhole presser device. The buttonhole presser device includes a fabric presser unit attached to a presser bar of the zigzag sewing machine and having an opening that allows a needle to pass therethrough; a fabric feed frame unit including a start position detecting member and an immovable receiving portion that has a frictional contact surface that contacts one end of a button, the fabric feed frame unit being slidable relative to the fabric presser unit between a start position and an end position of the buttonhole; a button-diameter measuring unit including an end position detecting member and a movable receiving portion that has a frictional contact surface that contacts the other end of a button, the button-diameter measuring unit being configured to grip a button by being slid relative to the fabric feed frame unit; and a fixing unit that fixes the button-diameter measuring unit to the fabric feed frame unit. The method includes a step of gripping a button between the immovable receiving portion and the movable receiving portion by sliding the button-diameter measuring unit relative to the fabric feed frame unit; a step of fixing the button-diameter measuring unit to the fabric feed frame unit by using the fixing unit; and a step of removing, after the step of fixing has been finished, the button from the buttonhole presser device and of stitching a buttonhole.

The buttonhole presser device and the method of stitching a buttonhole by using the buttonhole presser device according to the present invention can be used to stitch not only a buttonhole for a large button having a diameter greater than 25 mm but also a buttonhole for a button having a noncircular irregular shape. Therefore, by attaching the buttonhole presser device according to the present invention to a zigzag sewing machine, it is possible to stitch a buttonhole for a large button having a noncircular irregular shape, which has been difficult to stitch automatically with exiting technologies.

The buttonhole presser device according to the present invention may have two placement walls that are disposed in upright positions so as to be separated from each other by a predetermined distance in a direction perpendicular to a direction in which the button is gripped. In this case, it is possible to measure the diameter of a large button by stably placing the button on the two placement walls, and it is also possible to measure the diameter of a small button by placing the button between the two placement walls. As a result, a buttonhole having a length corresponding to a button having any size can be stitched.

In the buttonhole presser device according to the present invention, surfaces of the immovable receiving portion and the movable receiving portion that face each other and grips a button therebetween are frictional contact surfaces. Therefore, it is possible to grip a button that is not circular between the immovable receiving portion and the movable receiving portion in any orientation and to prevent the button from being rotated and removed from the button-diameter measuring unit.

In the method of stitching a buttonhole by using the buttonhole presser device according to the present invention, after fixing the button-diameter measuring unit to the fabric feed frame unit by using the fixing unit, the button is removed from the buttonhole presser device. Therefore, it is not necessary to stitch a buttonhole while a heavy large button is gripped by the buttonhole presser device. As a result, it is possible to prevent the buttonhole presser device from becoming inclined due to the weight of the button.

In the method of stitching a buttonhole by using the buttonhole presser device according to the present invention, the position at which the button-diameter measuring unit is fixed to the fabric feed frame unit may be caused to be displaced. By doing so, it is possible to finely adjust the length of the buttonhole to be slightly larger than or smaller than the diameter of the button that is gripped.

DESCRIPTION OF THE PREFERRED EMBODIMENTS

A buttonhole presser device according to an embodiment of the present invention will be described with reference to the drawings.

Figure 1:
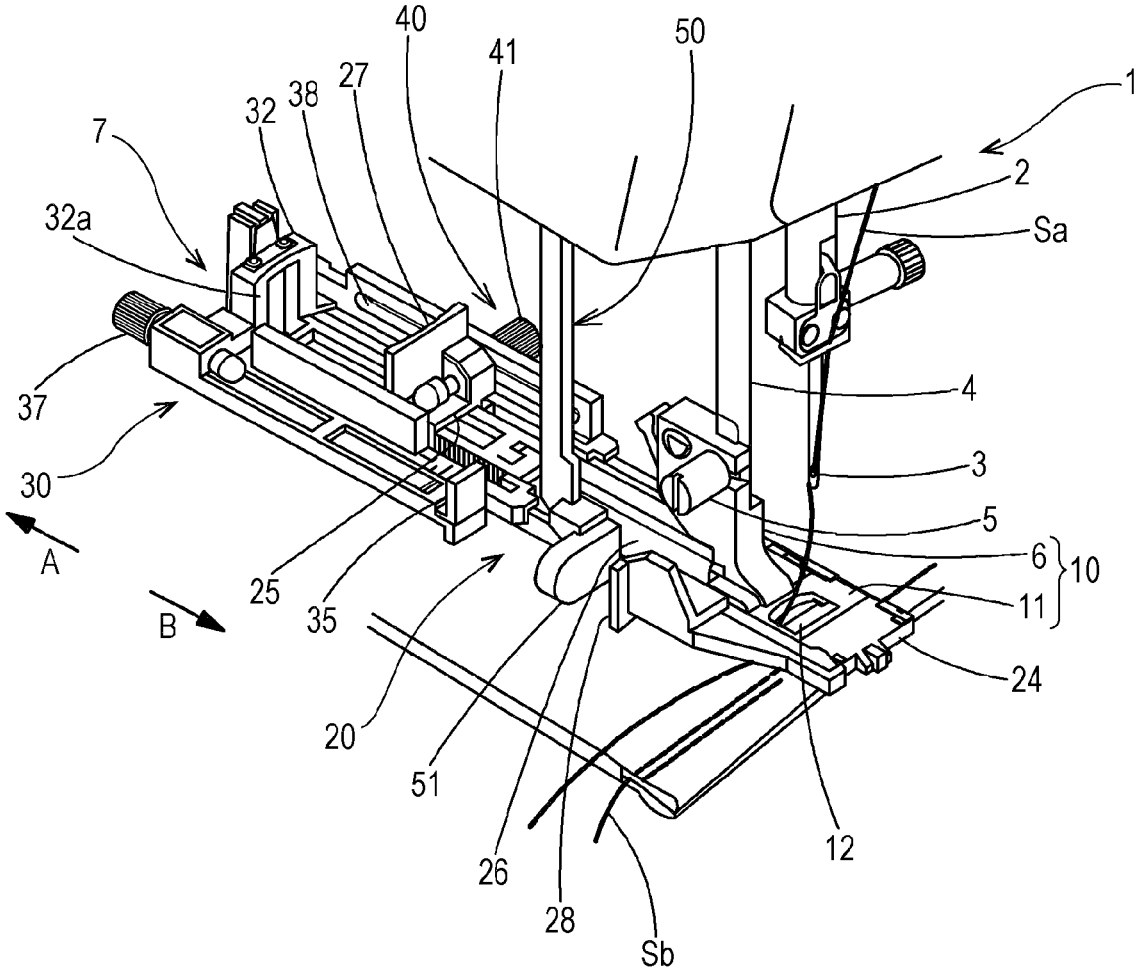
FIG. 1 is perspective view of a buttonhole presser device according to the present invention, which is attached to a zigzag sewing machine and being used.

Referring to FIG. 1, a head 1 supports a needle bar 2 in such a way that the needle bar 2 can reciprocate vertically and can move side-to-side horizontally. A needle 3 for carrying an upper thread Sa is attached to the needle bar 2. A presser bar 4 extends downward from the head 1. A presser holder 6 is fixed to a lower end of the presser bar 4 using a fastening screw 5.

Figure 2:
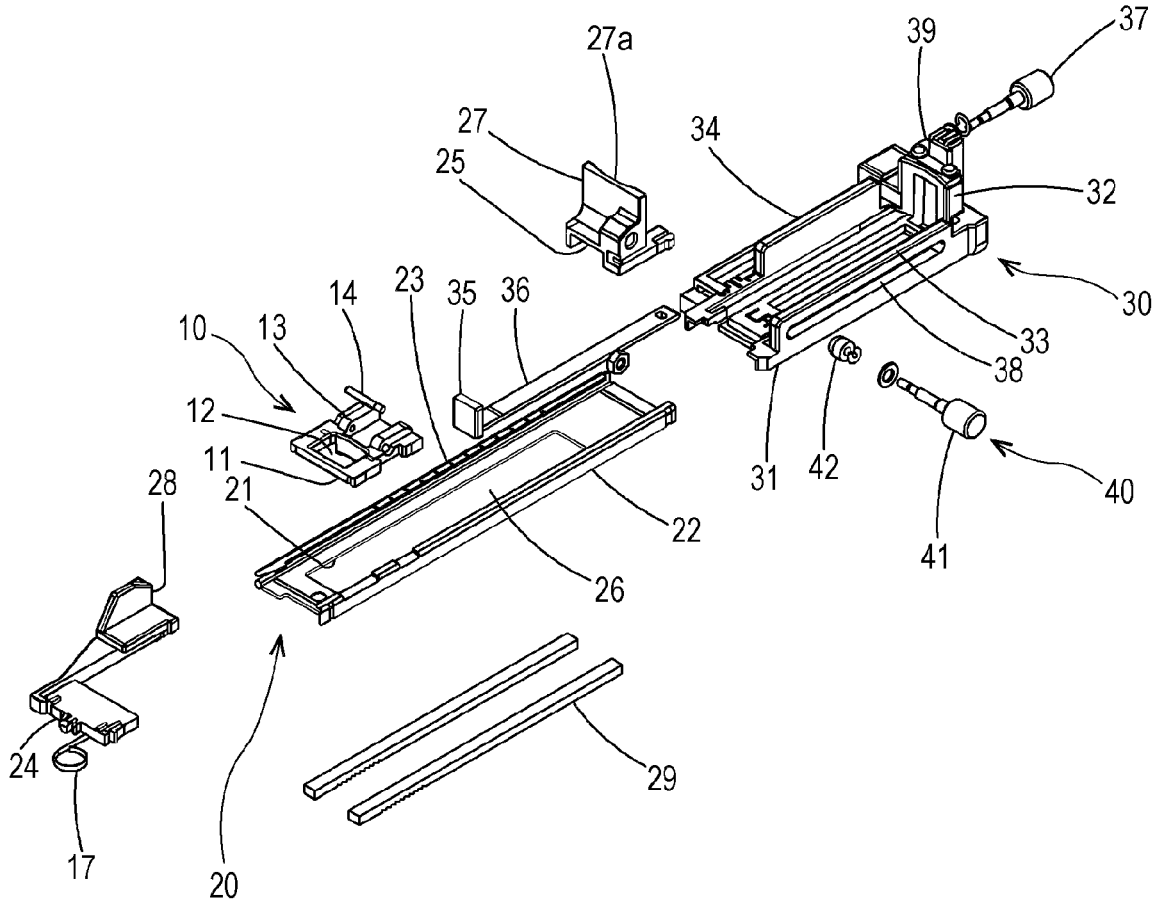
FIG. 2 is an exploded perspective view of the buttonhole presser device according to the present invention.

As illustrated in FIG. 2, a buttonhole presser device 7 includes a fabric presser unit 10, a fabric feed frame unit 20, a button-diameter measuring unit 30, and a fixing unit 40. The fabric feed frame unit 20 is slidable relative to the fabric presser unit 10 between a start position and an end position of a buttonhole. The button-diameter measuring unit 30 is disposed on the fabric feed frame unit 20. The fixing unit 40 fixes the button-diameter measuring unit 30 to the fabric feed frame unit 20.

Figure 3A:
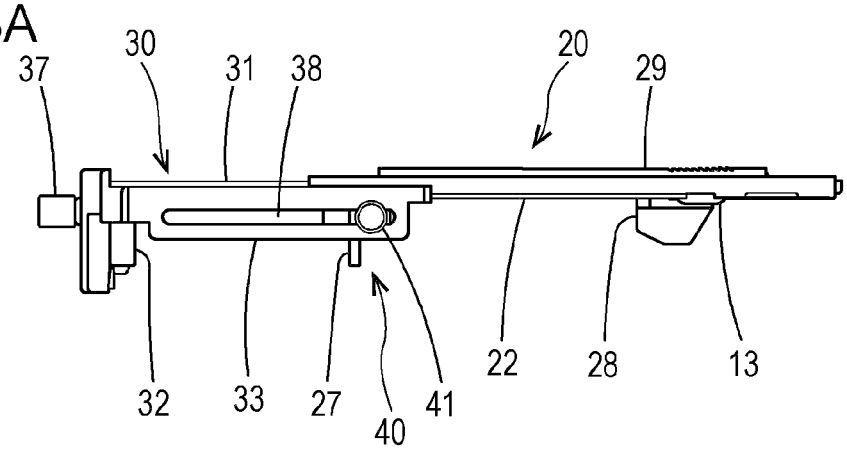
FIG. 3A is a left side view.
Figure 3B:
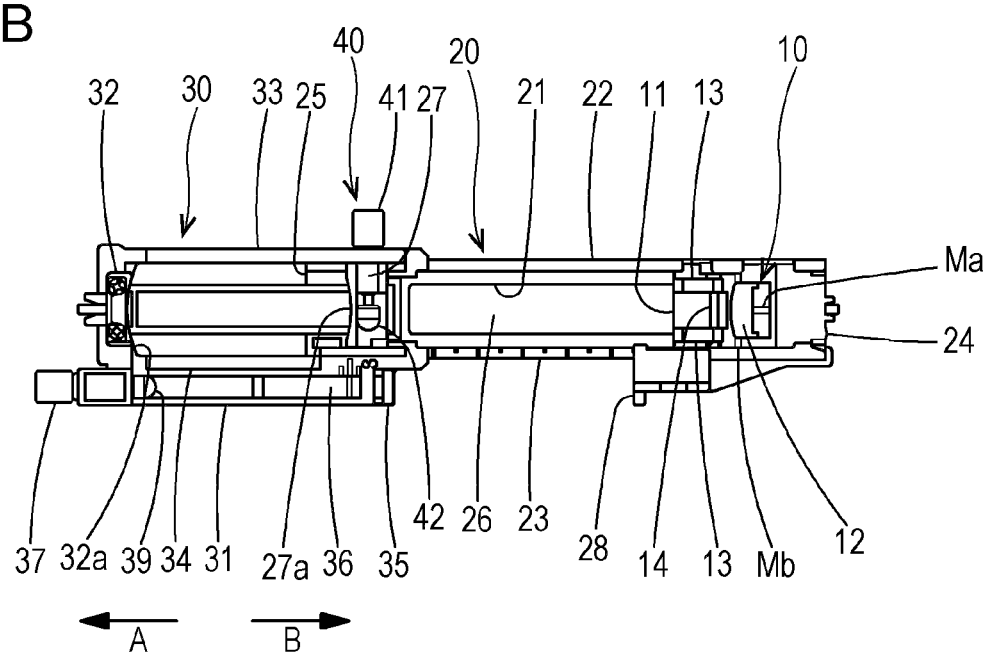
FIG. 3B is a top view.
Figure 3C:
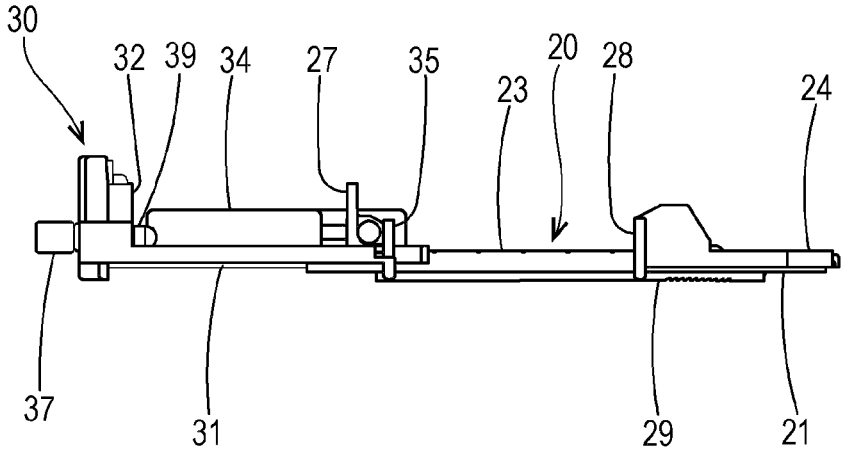
FIG. 3C is a right side view of the buttonhole presser device according to the present invention.

As illustrated in FIGS. 2 to 3C, the fabric presser unit 10 includes a presser foot 11, which has a plate-like shape and is made of a synthetic resin. A substantially rectangular opening 12, which allows the needle 3 to pass therethrough, is formed in the presser foot 11. Start marks Ma and Mb, which indicate positions to which the needle is to be lowered, are formed near the opening 12. A pair of cheek pieces 13 are integrally formed with the presser foot 11, and a pivot pin 14 is disposed so as to extend between the cheek pieces 13. The presser foot 11 is removably attached to the presser holder 6 via the pivot pin 14.

The fabric feed frame unit 20 is formed by bending a rectangular metal plate 21 along the longitudinal edges so as to form guide rails 22 and 23. The guide rails 22 and 23 have U-shaped cross sections and are disposed so as to face each other. The presser foot 11 is inserted into a space between the guide rails 22 and 23 so as to be slidable in the longitudinal direction.

The presser foot 11 is connected to a torsion spring 17. The torsion spring 17 is retractably disposed in a stopper member 24, which is made of a synthetic resin and fixed to one end portion of the fabric feed frame unit 20. Therefore, the stopper member 24 of the fabric feed frame unit 20 is urged by an elastic force of the torsion spring 17 so that the stopper member 24 is constantly in contact with an end surface of the presser foot 11. As described below, when the fabric feed frame unit 20 is moved by a feed dog in the backward direction, the fabric feed frame unit 20 slides in such a way that the stopper member 24 is moved away from the presser foot 11 against the elastic force of the torsion spring 17.

An end member 25 is inserted into and fixed to the other end portion of the fabric feed frame unit 20 along the guide rails 22 and 23. An elongated hole 26, which allows the needle 3 to pass therethrough, is formed between the stopper member 24 and the end member 25 of the fabric feed frame unit 20 so as to extend in the direction in which the fabric feed frame unit 20 is slidable relative to the presser foot 11. The elongated hole 26 has an opening that is large enough to surround an area in which a buttonhole having the largest size is to be formed in a piece of fabric.

An immovable receiving portion 27 stands on the end member 25. The immovable receiving portion 27 grips a button in corporation with a movable receiving portion 32 (described below) by coming into contact with one end of the button. A frictional contact surface 27*a*, which contacts a side surface of a button, is formed on a side of the immovable receiving portion 27 facing the movable receiving portion 32. By means of the frictional contact surface 27*a*, the immovable receiving portion 27 can grip a large button while preventing the button from naturally sliding and rotating. It is preferable that vertical or diagonal knurls be formed on the frictional contact surface 27*a*. However, any appropriate method may be used to increase the frictional coefficient of the frictional contact surface 27*a*. A start position detecting member 28 stands on one side portion of the stopper member 24.

As illustrated in FIGS. 3A and 3C, a frictional engagement member 29 is affixed to a lower surface of the fabric feed frame unit 20 along the guide rails 22 and 23. The frictional engagement member 29, which is made from a synthetic rubber strip, serves to steadily feed a piece of fabric by being frictionally engaged with the piece of fabric.

The button-diameter measuring unit 30 includes a scale frame 31, which is made of a synthetic resin and has a substantially rectangular shape. The button-diameter measuring unit 30 is slidable toward the end member 25 in the longitudinal direction of the fabric feed frame unit 20. The movable receiving portion 32 stands on a back end portion of the scale frame 31. The movable receiving portion 32 grips a button C or D (described below) in corporation with the immovable receiving portion 27. As with the immovable receiving portion 27, a frictional contact surface 32*a* is formed on a side of the movable receiving portion 32 facing the immovable receiving portion 27. The frictional contact surface 32*a* comes into contact with a side surface of a button.

Placement walls 33 and 34 stand on end portions of the scale frame 31 in the width direction (a direction perpendicular to a direction in which a button is to be gripped). The placement walls 33 and 34, which allow a button to be placed thereon in the horizontal position, are disposed so as to be separated from each other by a predetermined distance. It is necessary that the distance between the placement walls 33 and 34 be greater than 25 mm so that the diameter of a small button having a diameter of 25 mm or less can be measured by placing the button between the placement walls 33 and 34.

The scale frame 31 includes an end position adjustment plate 36 in a lower part thereof facing the start position detecting member 28. An end position detecting member 35 is formed at an end of the end position adjustment plate 36. The end position adjustment plate 36 can be slid relative to the scale frame 31 by rotating an adjustment screw 37. A retainer 39 is attached to the adjustment screw 37.

In the present embodiment, the fixing unit 40 includes a scale frame fixing screw 41 and a retainer 42. The scale frame fixing screw 41 is screwed into the end member 25 of the fabric feed frame unit 20 through a horizontally elongated slit 38, which is formed in the placement wall 33 of the button-diameter measuring unit 30, thereby fixing the button-diameter measuring unit 30 to the fabric feed frame unit 20.

As illustrated in FIG. 1, a buttonhole switching lever 50 (hereinafter, referred to as a "BH lever 50") extends downward from the head 1, and an abutting portion 51 of the BH lever 50 is located between the start position detecting member 28 and the end position detecting member 35. Thus, when the fabric feed frame unit 20 reaches a predetermined position, one of the detection members collides with the abutting portion, and thereby the fabric feed direction for buttonhole stitching is switched.

Next, the operations and the effects of the present embodiment will be described. Before stitching a buttonhole by using the buttonhole presser device according to the present embodiment, it is necessary to perform the following preliminary operations: (1) an operation of measuring the diameter of a button, (2) an operation of attaching a buttonhole presser device, and (3) an operation of positioning a piece of fabric.

Figure 4:
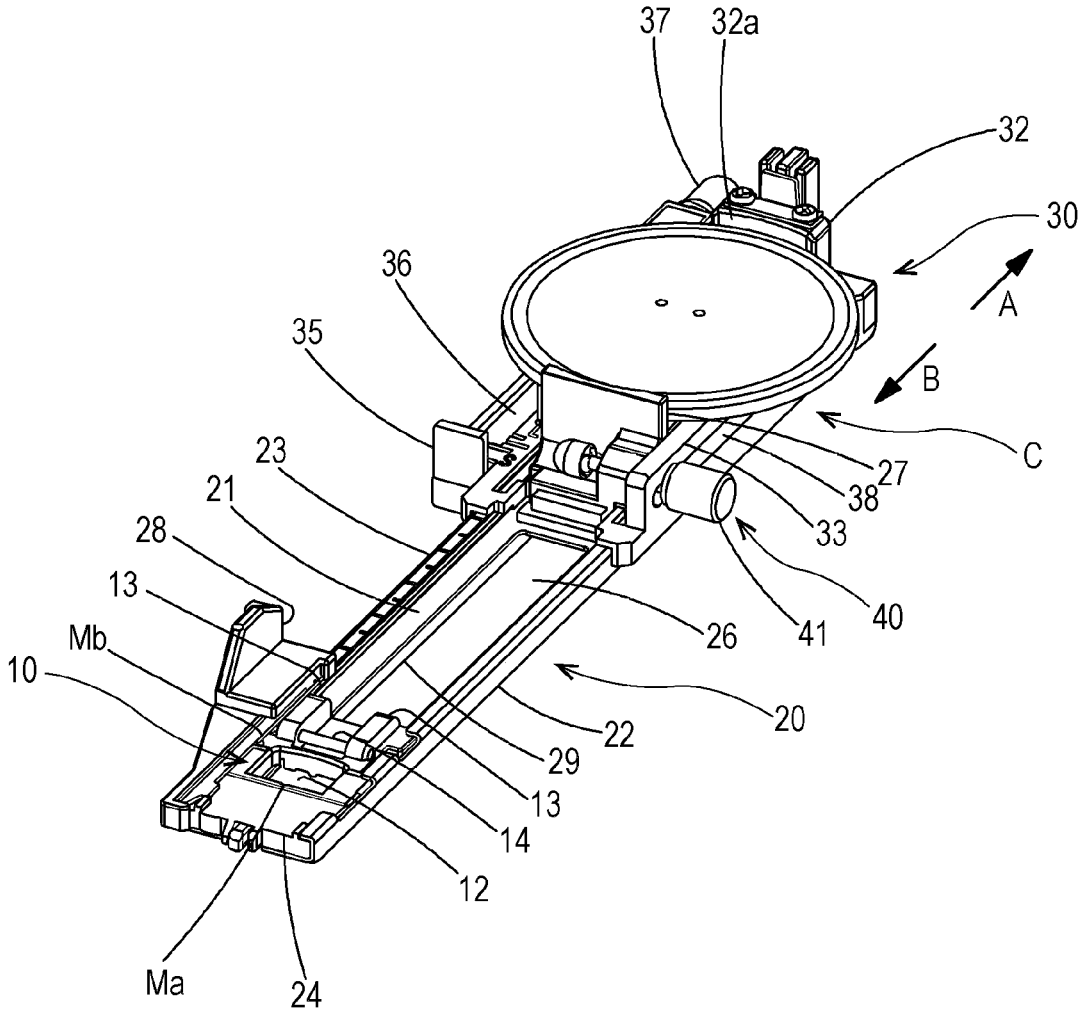
FIG. 4 is a perspective view of the buttonhole presser device according to the present invention, on which a circular button is placed.

The operation of measuring the diameter of a button is performed in the following way. First, the scale frame fixing screw 41 is loosened, and the scale frame 31 is slid outward relative to the fabric feed frame unit 20 in the direction A shown in FIGS. 1, 3B, and 4. Next, a circular button C, for which a buttonhole is to be stitched, is placed on the placement walls 33 and 34. Then, the scale frame 31 is slid back in the direction B so that the button C is held between the frictional contact surfaces 27*a* and 32*a* of the immovable receiving portion 27 and the movable receiving portion 32. Subsequently, the scale frame 31 is fixed to the fabric feed frame unit 20 by tightening the scale frame fixing screw 41, and then the button C is removed, thereby finishing an operation of measuring the diameter of the button.

Figure 5:
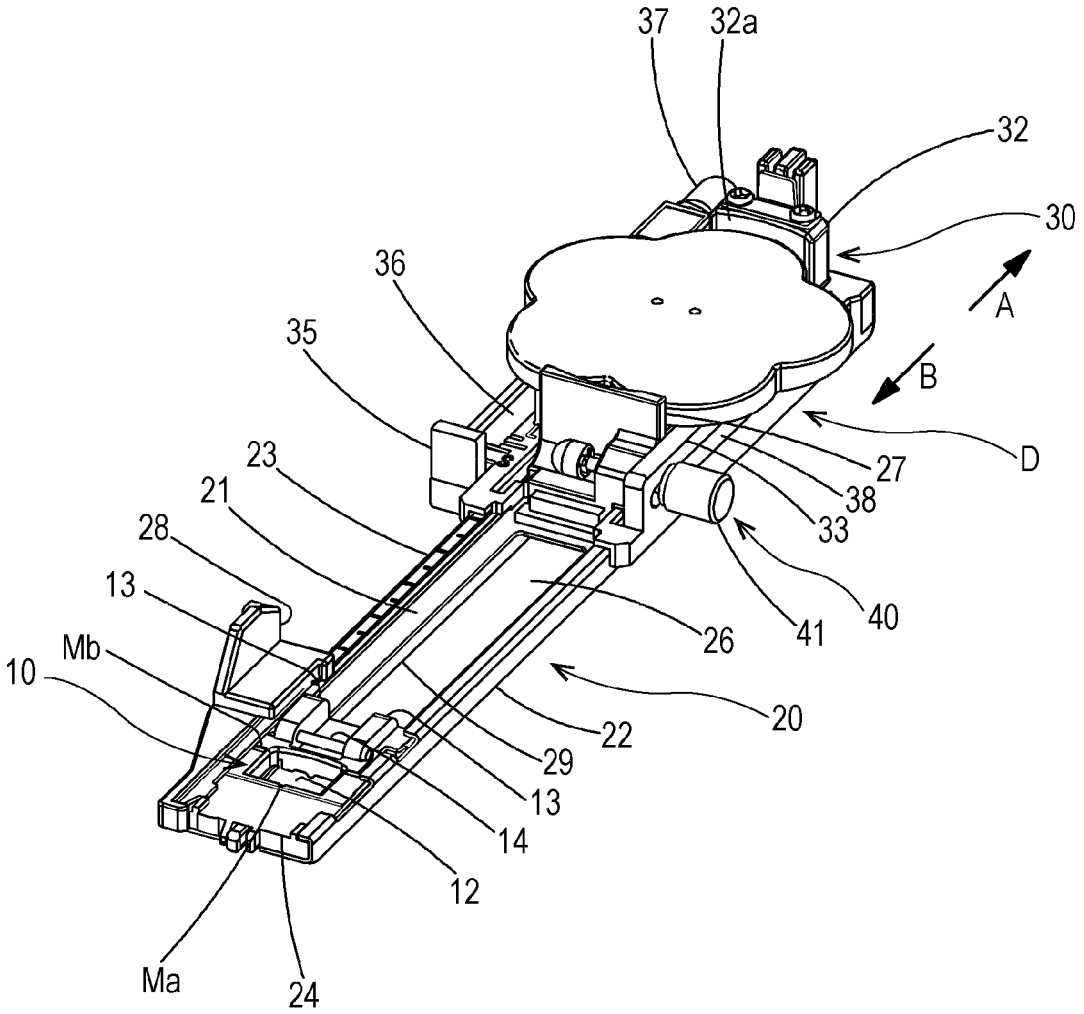
FIG. 5 is a perspective view of the buttonhole presser device according to the present invention, on which a flower-shaped button is placed.

In the measuring operation described above, the diameter of the circular button C is measured. In order to stitch a buttonhole for a noncircular irregularly-shaped button D, which is flower-shaped as shown in FIG. 5, the irregularly-shaped button D is placed on the placement walls 33 and 34, and the scale frame 31 is slid back in the direction B so that the button D is held between the frictional contact surfaces 27*a* and 32*a* of the immovable receiving portion 27 and the movable receiving portion 32. Subsequently, the scale frame 31 is fixed to the fabric feed frame unit 20 by tightening the scale frame fixing screw 41, and then the button D is removed, thereby finishing an operation of measuring the diameter of the button.

In contrast to the case of measuring the circular button C, it is important to place the irregularly-shaped button D on the placement walls 33 and 34 so that the orientation of the button D is aligned with the orientation in which the button D is to be attached to a garment. The irregularly-shaped button D can be gripped between the immovable receiving portion 27 and the movable receiving portion 32 in an appropriate direction. Because the frictional contact surfaces 27*a* and 32*a* are formed on opposing sides of the immovable receiving portion 27 and the movable receiving portion 32, it is possible to grip the button D so that the button D might not naturally rotate and might not be removed from the immovable receiving portion 27 and the movable receiving portion 32.

According to the present embodiment, when it is necessary to set the length of a buttonhole stitch to be slightly larger than the standard length in the operation of measuring the diameter of a button, the end position adjustment plate 36 is slid in the direction A shown in FIGS. 1, 3B, 4, and 5 by rotating the adjustment screw 37 so as to move the end position detecting member 35 slightly away from the start position detecting member 28. On the other hand, when it is necessary to set the length of a buttonhole stitch to be slightly shorter than the standard length, the end position adjustment plate 36 is slid in the direction B shown in FIGS. 1, 3B, 4, and 5 by rotating the adjustment screw 37 in the opposite direction so as to move the end position detecting member 35 slightly closer to the start position detecting member 28.

After a buttonhole has been stitched, the adjustment screw 37 should be reset to the original position. However, it is not necessary to provide the end position adjustment plate 36 in order to adjust the length of a buttonhole stitch. This is because, a buttonhole presser device according to the present invention is characterized in that the length of a buttonhole stitch can be adjusted by loosening the scale frame fixing screw 41, changing the position at which the scale frame 31 is fixed to the fabric feed frame unit 20 in the direction A or B, and moving the end position detecting member 35 away from or closer to the start position detecting member 28.

The operation of attaching the buttonhole presser device 7 is performed in the following way. First, as illustrated in FIG. 1, the needle 3 is raised, the presser bar 4 and the presser holder 6 are lifted, and the buttonhole presser device 7 is placed on the bed of the sewing machine, which is located below the head 1. Next, the position of an engagement groove formed in a lower surface of the presser holder 6 is adjusted with the position of the pivot pin 14 of the presser foot 11, and the presser bar 4 is lowered. Then, the presser holder 6 is lowered and the presser foot 11 is attached to the presser holder 6 via the pivot pin 14.

The operation of positioning a piece of fabric is performed in the following way. First, the BH lever 50, which extends downward from the head 1, is lowered until the BH lever is stopped. Next, as illustrated in FIG. 1, the presser bar 4 is raised, the upper thread Sa is passed through the opening 12 in the presser foot 11, and the upper thread Sa is drawn out horizontally so as to be aligned with a lower thread Sb, which has been drawn out from the bed of the sewing machine.

Next, a piece of fabric is placed between the buttonhole presser device 7 and the bed of the sewing machine. Then, the positions of the start marks Ma and Mb of the presser foot 11 shown in FIG. 3B and the position of a buttonhole mark Mc shown in FIG. 6A, which is formed beforehand at a position on the piece of fabric where a buttonhole is to be stitched, are adjusted with each other.

Before starting to stitch a buttonhole, it is necessary to check that there is no space between the presser foot 11 and the stopper member 24 of the fabric feed frame unit 20. If there is a space, displacement from the end point Me may occur when a buttonhole has been stitched. Therefore, it is necessary to check that the presser foot 11 is in contact with the stopper member 24 due to an elastic force of the torsion spring 17.

After finishing the preliminary operations as described above, the presser bar 4 is lowered, and then an automatic buttonhole stitching mode is selected by operating the pattern selecting device of the zigzag sewing machine. Then, by starting buttonhole stitching, a buttonhole can be stitched through the steps described below. When stitching is finished, the sewing machine is automatically stopped.

Figure 6A:
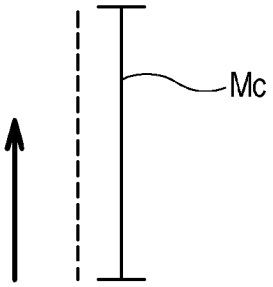
FIGS. 6A and 6B illustrate a first step.
Figure 6B:
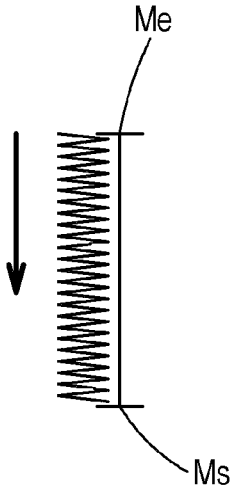

In a first step, as shown in FIG. 6A, the fabric feed frame unit 20 is fed relative to the presser foot 11 in the direction B shown in FIG. 1, which is a backward direction, against an elastic force of the torsion spring 17, and temporary stitching on the left side of the button hole is started. When reaching a position where temporary stitching is to be finished, the abutting portion 51 of the BH lever 50 collides with the end position detecting member 35, thereby a sensor in the head 1 outputs a signal for switching the fabric feed direction. As a result, the feed direction of the fabric feed frame unit 20 is changed to the direction A, which is a forward direction, and a line tack on the left side is started to be stitched as shown in FIG. 6B. Next, when reaching a position where the line tack on the left side is to be finished, the abutting portion 51 of the BH lever 50 collides with the start position detecting member 28, thereby the sensor outputs a switching signal. As a result, the line tack stitch on the left side is finished and the fabric feed direction is changed to the forward direction.

Figure 6C:
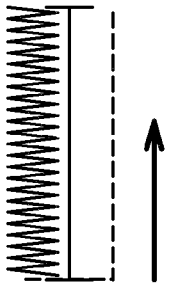
FIGS. 6C and 6D illustrate a second step.
Figure 6D:
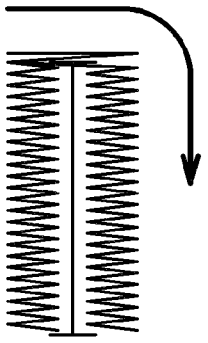

In a second step, as shown in FIG. 6C, in the same way as in the first step, the fabric feed frame unit 20 is fed relative to the presser foot 11 in the direction B shown in FIG. 1, which is the backward direction, and temporary stitching on the right side is started. When the abutting portion 51 of the BH lever 50 collides with the end position detecting member 35, the feed direction of the fabric feed frame unit 20 is changed to the direction A, which is the forward direction. As shown in FIG. 6D, several stitches of bar tacks are sewn at one end of the buttonhole, and then a line tack on the right side is started to be stitched. Next, when reaching a position where the line tack is to be finished, the abutting portion 51 of the BH lever 50 collides with the start position detecting member 28. As a result, the line tack stitch on the right side is finished and the fabric feed direction is changed to the forward direction.

Figure 6E:
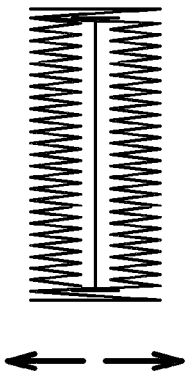
FIG. 6E illustrates a third step of a method of stitching a buttonhole by using the buttonhole presser device according to the present invention.

In a third step, as shown in FIG. 6E, several stitches of bar tacks are sewn at the other end of the buttonhole, overstitch is performed to finish buttonhole stitching, and the sewing machine is automatically stopped. After stitching of one buttonhole has been finished, the needle 3 is raised, the presser bar 4 is lifted to move the buttonhole presser device 7 away from the fabric, the fabric is moved to a position where the next buttonhole is to be stitched, and the buttonhole is stitched in the same way as described above. By repeating this process a necessary number of times, a predetermined number of buttonholes can be stitched.

After finishing buttonhole stitching, the BH lever 50 is lifted until the BH lever 50 is stopped and returned to the original state. Subsequently, the upper thread Sa and the lower thread Sb are cut by using the automatic thread cutting device, or, a push-up lever is lifted and a fabric in which buttonholes have been stitched is removed from a space between the buttonhole presser device 7 and the needle plate, and the upper thread Sa and the lower thread Sb extending from the fabric are cut with scissors or the like, thereby finishing the buttonhole forming process.

As heretofore described, by attaching the buttonhole presser device according to the present embodiment to a zigzag sewing machine, it is possible to automatically stitch a buttonhole for a large button having a noncircular irregular shape for which it is not possible to stitch a buttonhole with existing technologies.

In the buttonhole presser device according to the present invention, surfaces of the immovable receiving portion and the movable receiving portion that face each other and that grip a button therebetween are frictional contact surfaces. Therefore, the buttonhole presser device is capable of gripping a button having a noncircular irregular shape in any orientation while preventing the button from naturally rotating and being removed from the immovable receiving portion and the movable receiving portion. In particular, by forming knurls in the vertical direction on the frictional contact surfaces, a higher friction is generated in the rotational direction. In this case, a button having a noncircular irregular shape can be gripped in any orientation and the button can be removed easily because the frictional resistance is small.

In the case where a buttonhole is stitched by using the buttonhole presser device according to the present embodiment, the length of the buttonhole can be made larger than or smaller than the standard length of the buttonhole corresponding to the diameter of the button by loosening the scale frame fixing screw and finely adjusting the position at which the scale frame is fixed to the fabric feed frame unit.

It is needless to say that the present embodiment, with which it is possible to stitch a buttonhole for a large button having a diameter greater than 25 mm and less than about 50 mm, can be used to stitch a buttonhole corresponding to an even larger button.

In contrast to existing devices and methods, the buttonhole presser device and the method of stitching a buttonhole by using the buttonhole presser device according to the present invention can be used to stitch not only a buttonhole for a large button having a diameter greater than 25 mm but also a buttonhole for a button having a noncircular irregular shape. Therefore, it is possible to stitch a buttonhole for a large button having a noncircular irregular shape in an orientation in which the button is to be attached to a garment. As a result, the device and the method can be used advantageously for various sewing machines.

What is claimed is:

1. A buttonhole presser device for stitching a buttonhole having a length corresponding to a diameter of a button by measuring the diameter of the button and automatically switching a fabric feed direction on the basis of the measured diameter of the button, the buttonhole presser device comprising:

a fabric presser unit attached to a presser bar of the zigzag sewing machine and having an opening that allows a needle to pass therethrough;

a fabric feed frame unit including a start position detecting member and an immovable receiving portion that has a frictional contact surface that contacts one end of a button, the fabric feed frame unit being slidable relative to the fabric presser unit between a start position and an end position of the buttonhole;

a button-diameter measuring unit including an end position detecting member and a movable receiving portion that has a frictional contact surface that contacts the other end of the button, the button-diameter measuring unit being configured to grip the button by being slid relative to the fabric feed frame unit; and a fixing unit that fixes the button-diameter measuring unit to the fabric feed frame unit when the button-diameter measuring unit is gripping the button between the immovable receiving portion and the movable receiving portion and that allows the button to be removed after the button-diameter measuring unit has been fixed to the fabric feed frame unit.

2. The buttonhole presser device according to claim 1, wherein the button-diameter measuring unit places a button on two placement walls in a horizontal position, the placement walls being disposed in upright positions so as to be separated from each other by a predetermined distance in a direction perpendicular to a direction in which the button-diameter measuring unit grips the button.

3. The buttonhole presser device according to claim 1, wherein the immovable receiving portion and the movable receiving portion are capable of gripping a noncircular button therebetween in any orientation.

4. The buttonhole presser device according to claim 2, wherein the immovable receiving portion and the movable receiving portion are capable of gripping a noncircular button therebetween in any orientation.

5. A method for stitching a buttonhole having a length corresponding to a diameter of a button by measuring the diameter of the button and automatically switching a fabric feed direction on the basis of the measured diameter of the button by using a buttonhole presser device, the buttonhole presser device including a fabric presser unit attached to a presser bar of the zigzag sewing machine and having an opening that allows a needle to pass therethrough; a fabric feed frame unit including a start position detecting member and an immovable receiving portion that has a frictional contact surface that contacts one end of a button, the fabric feed frame unit being slidable relative to the fabric presser unit between a start position and an end position of the buttonhole; a button-diameter measuring unit including an end position detecting member and a movable receiving portion that has a frictional contact surface that contacts the other end of the button, the button-diameter measuring unit being configured to grip the button by being slid relative to the fabric feed frame unit; and a fixing unit that fixes the button-diameter measuring unit to the fabric feed frame unit, the method comprising:

a step of gripping a button between the immovable receiving portion and the movable receiving portion by sliding the button-diameter measuring unit relative to the fabric feed frame unit;

a step of fixing the button-diameter measuring unit to the fabric feed frame unit by using the fixing unit; and a step of removing, after the step of fixing has been finished, the button from the buttonhole presser device and of stitching a buttonhole.

6. The method of stitching a buttonhole by using a buttonhole presser device according to claim 5, further comprising:

a step of placing, before performing the step of gripping, the button in a horizontal position on two placement walls of the button-diameter measuring unit that are disposed in upright positions so as to be separated from each other by a predetermined distance in a direction perpendicular to a direction in which the button is to be gripped.

7. The method of stitching a buttonhole by using a buttonhole presser device according to claim 6, wherein the step of placing includes a step of orienting a noncircular button in an appropriate orientation.

8. The method of stitching a buttonhole by using a buttonhole presser device according to claim 7, wherein the step of gripping includes a step of holding a noncircular button in an appropriate orientation between the frictional contact surface of the immovable receiving portion and the frictional contact surface of the movable receiving portion.

9. The method of stitching a buttonhole by using a buttonhole presser device according to claim 5, further comprising:

a step of adjusting a length of a buttonhole stitch by displacing a position at which the button-diameter measuring unit is fixed to the fabric feed frame unit.

10. The method of stitching a buttonhole by using a buttonhole presser device according to claim 6, further comprising:

a step of adjusting a length of a buttonhole stitch by displacing a position at which the button-diameter measuring unit is fixed to the fabric feed frame unit.

11. The method of stitching a buttonhole by using a buttonhole presser device according to claim 7, further comprising:

a step of adjusting a length of a buttonhole stitch by displacing a position at which the button-diameter measuring unit is fixed to the fabric feed frame unit.

12. The method of stitching a buttonhole by using a buttonhole presser device according to claim 8, further comprising:

a step of adjusting a length of a buttonhole stitch by displacing a position at which the button-diameter measuring unit is fixed to the fabric feed frame unit.

* * * * *